US008371815B2

(12) United States Patent
Farrell

(10) Patent No.: US 8,371,815 B2
(45) Date of Patent: Feb. 12, 2013

(54) APPARATUS FOR COOLING AN AIRFOIL

(75) Inventor: Thomas Raymond Farrell, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 511 days.

(21) Appl. No.: 12/725,660

(22) Filed: Mar. 17, 2010

(65) Prior Publication Data

US 2011/0229343 A1 Sep. 22, 2011

(51) Int. Cl.
*F01D 5/18* (2006.01)

(52) U.S. Cl. ..... 416/97 R

(58) Field of Classification Search ..... 415/115; 416/96 R, 97 R, 97 A
See application file for complete search history.

(56) References Cited

U.S. PATENT DOCUMENTS 3,623,825 A * 11/1971 Schneider ..... 416/96 R
6,997,679 B2 2/2006 Beddard et al.
7,080,971 B2 7/2006 Wilson et al.
2005/0111978 A1 5/2005 Strohl et al.
2006/0171808 A1 8/2006 Liang
2008/0145236 A1 6/2008 Liang
2008/0279695 A1 11/2008 Abdel-Messeh et al.
2009/0035146 A1 2/2009 Arness et al.

* cited by examiner

*Primary Examiner* — Dwayne J White
(74) *Attorney, Agent, or Firm* — Dority & Manning, P.A.

(57) ABSTRACT

An apparatus for cooling an airfoil is provided. The airfoil includes an upper airfoil section, a lower airfoil section, at least one cooling passage, and a transition section. The at least one cooling passage is defined at least partially within the lower airfoil section. The at least one cooling passage is configured to flow a cooling medium therethrough, cooling at least a portion of the airfoil. The transition section is disposed between the upper airfoil section and the lower airfoil section and has an outer surface. The outer surface defines at least one cooling hole. The at least one cooling hole is fluidly connected to the at least one cooling passage. At least a portion of the cooling medium is exhausted through the at least one cooling hole.

20 Claims, 3 Drawing Sheets

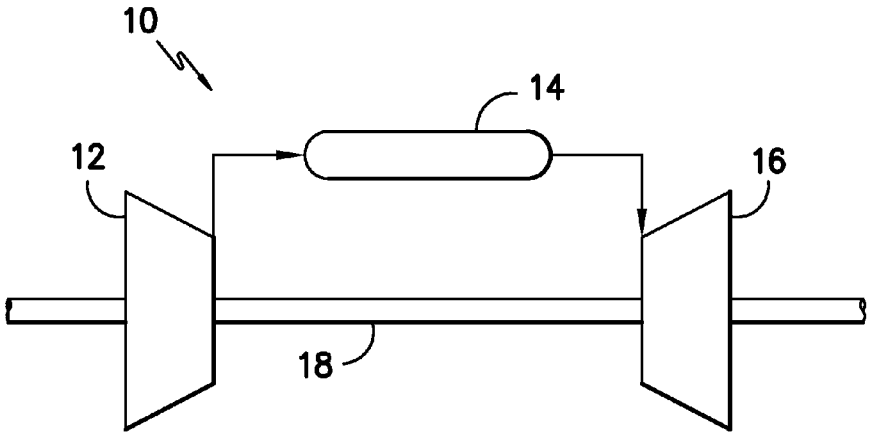
FIG. –1–
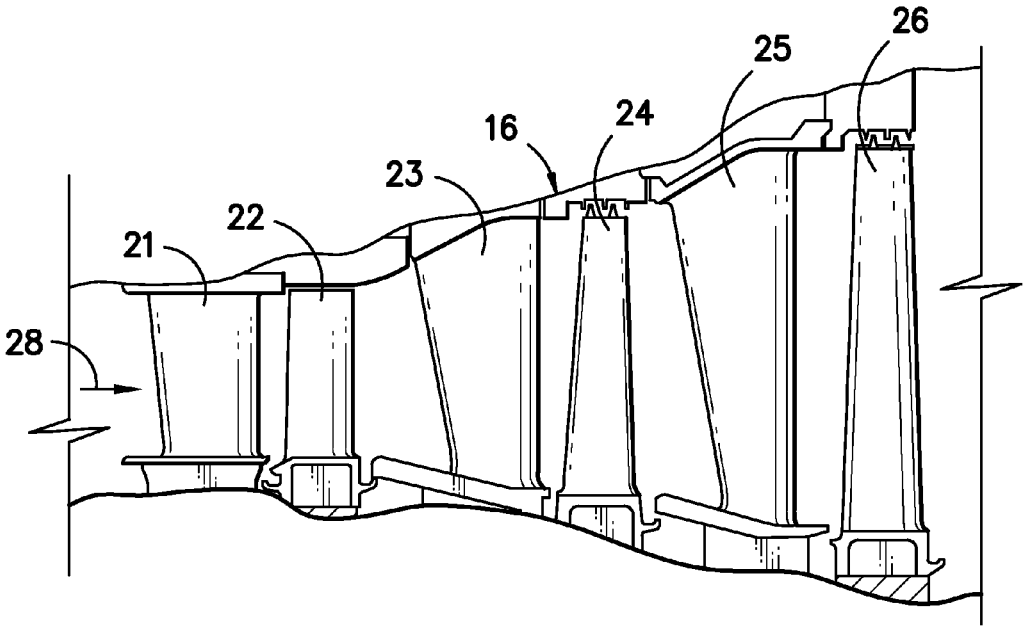
FIG. –2–

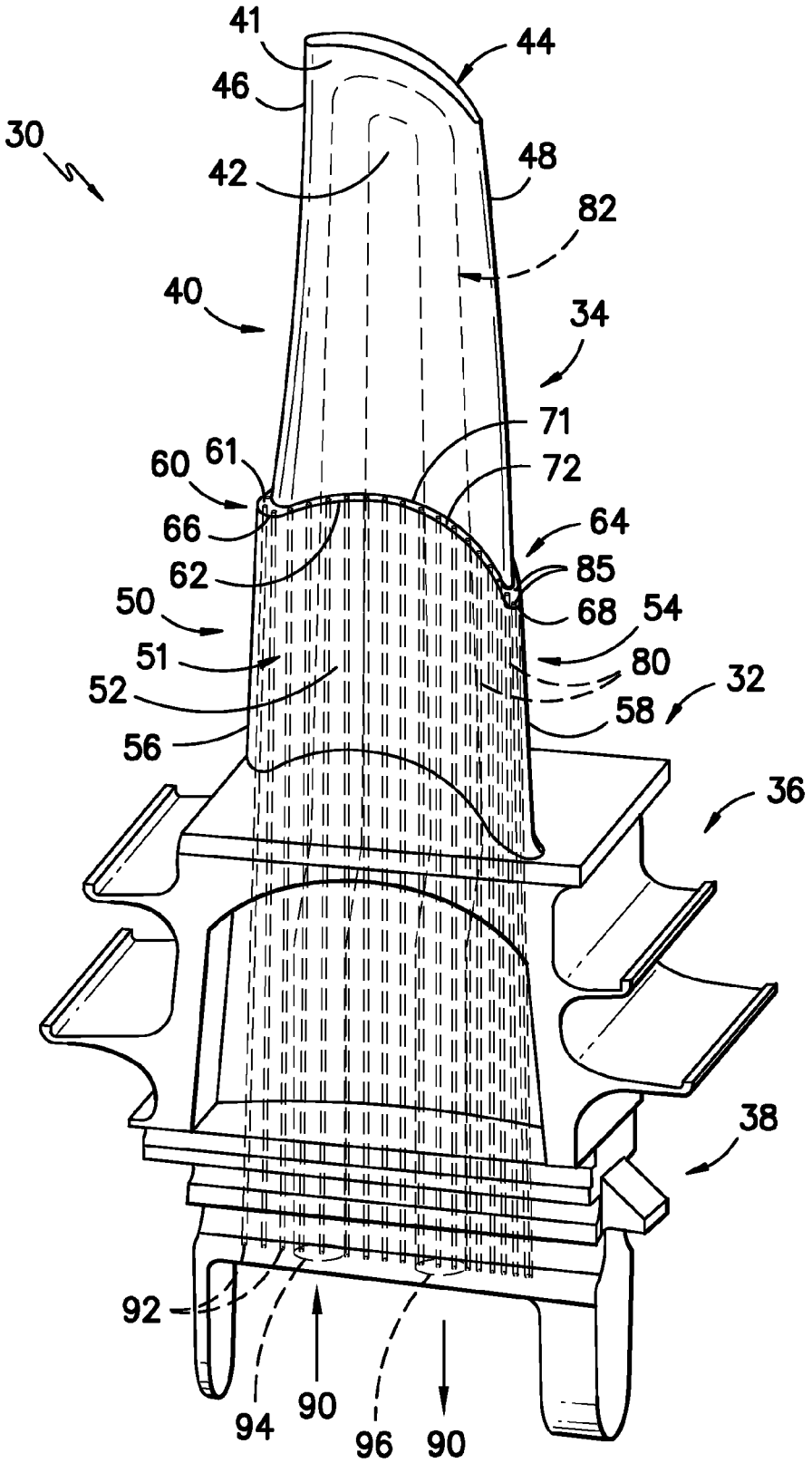
FIG. —3—

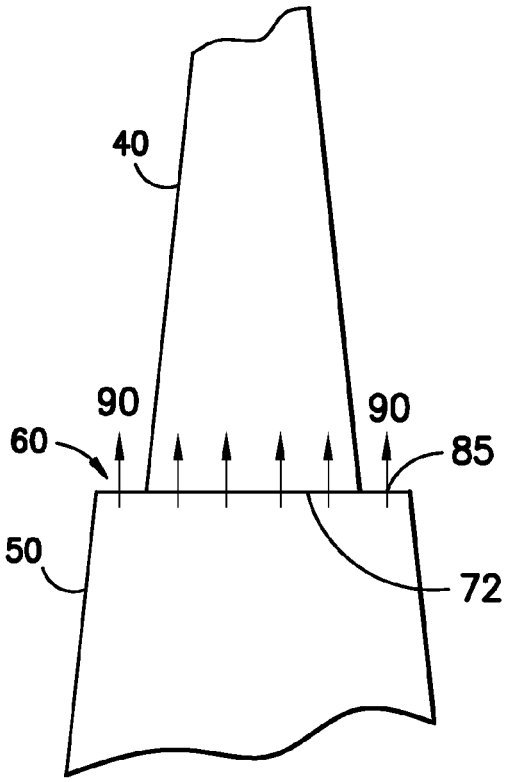
FIG. –4–
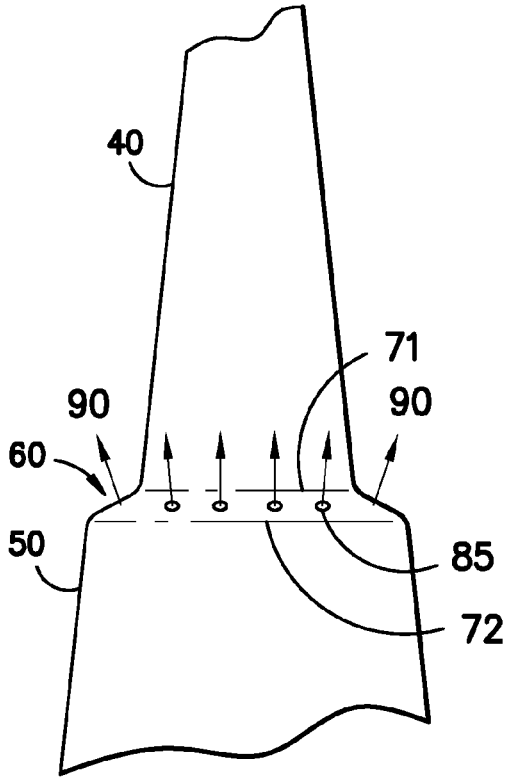
FIG. –5–

APPARATUS FOR COOLING AN AIRFOIL

FIELD OF THE INVENTION

The subject matter disclosed herein relates generally to airfoils, and more specifically to cooling apparatus for airfoils.

BACKGROUND OF THE INVENTION

Gas turbine systems are widely utilized in fields such as power generation. A conventional gas turbine system includes a compressor, a combustor, and a turbine. During operation of the gas turbine system, various components in the system are subjected to high temperature flows, which can cause the components to fail. Since higher temperature flows generally result in increased performance, efficiency, and power output of the gas turbine system, the components that are subjected to high temperature flow must be cooled to allow the gas turbine system to operate at increased temperatures.

Various strategies are known in the art for cooling various gas turbine system components. For example, a cooling medium may be routed from the compressor and provided to various components. In the turbine section of the system, the cooling medium may be utilized to cool various turbine components, including components in the hot gas path of the turbine.

Airfoils are one example of a hot gas path component that must be cooled. For example, both turbine buckets and turbine nozzles incorporate airfoils, and the airfoils are constantly subject to high temperature flows during operation of the gas turbine system. If the airfoils are not cooled, either the temperature of the hot gas flow must be limited, reducing the performance of the gas turbine system, or the airfoils may be at risk of becoming damaged and failing.

Various strategies are known in the art for cooling airfoils. For example, one prior art strategy flows a cooling medium through radial cooling passages that extend through the length of the airfoil. The cooling medium is then exhausted through the tip of the airfoils. However, many airfoils, such as latter-stage buckets, are too long and are curved along the length of the airfoil, preventing the radial cooling passages from extending through the length of the airfoil.

Thus, a cooling device for an airfoil that allows radial cooling passages to be utilized without requiring the cooling passages to extend through the entire length of the airfoil would be welcome in the art. Further, a cooling device that allows radial cooling of the airfoil and that allows the cooling medium to be exhausted from the airfoil along the length of the airfoil would be advantageous.

BRIEF DESCRIPTION OF THE INVENTION

Aspects and advantages of the invention will be set forth in part in the following description, or may be obvious from the description, or may be learned through practice of the invention.

In one embodiment, an airfoil is provided. The airfoil includes an upper airfoil section, a lower airfoil section, at least one cooling passage, and a transition section. Each of the upper and lower airfoil sections has an outer surface including a pressure side section, a suction side section, a leading edge, and a trailing edge. The at least one cooling passage is defined at least partially within the lower airfoil section. The at least one cooling passage is configured to flow a cooling medium therethrough, cooling at least a portion of the airfoil. The transition section is disposed between the upper airfoil section and the lower airfoil section and has an outer surface. The outer surface defines at least one cooling hole. The at least one cooling hole is fluidly connected to the at least one cooling passage. At least a portion of the cooling medium is exhausted through the at least one cooling hole.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a schematic illustration of a gas turbine system;

FIG. 2 is a sectional side view of the turbine section of a gas turbine system according to one embodiment of the present disclosure;

FIG. 3 is a perspective view of a bucket assembly according to one embodiment of the present disclosure;

FIG. 4 is a cross-sectional view of an airfoil according to one embodiment of the present disclosure; and FIG. 5 is a cross-sectional view of an airfoil according to another embodiment of the present disclosure.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, a combustor 14, and a turbine 16. The compressor 12 and turbine 16 may be coupled by a shaft 18. The shaft 18 may be a single shaft or a plurality of shaft segments coupled together to form shaft 18.

The turbine 16 may include a plurality of turbine stages. For example, in one embodiment, the turbine 16 may have three stages, as shown in FIG. 2. For example, a first stage of the turbine 16 may include a plurality of circumferentially spaced nozzles 21 and buckets 22. The nozzles 21 may be disposed and fixed circumferentially about the shaft 18. The buckets 22 may be disposed circumferentially about the shaft 18 and coupled to the shaft 18. A second stage of the turbine 16 may include a plurality of circumferentially spaced nozzles 23 and buckets 24. The nozzles 23 may be disposed and fixed circumferentially about the shaft 18. The buckets 24 may be disposed circumferentially about the shaft 18 and coupled to the shaft 18. A third stage of the turbine 16 may include a plurality of circumferentially spaced nozzles 25 and buckets 26. The nozzles 25 may be disposed and fixed circumferentially about the shaft 18. The buckets 26 may be disposed circumferentially about the shaft 18 and coupled to the shaft 18. The various stages of the turbine 16 may be disposed in the turbine 16 in the path of hot gas flow 28. It should be understood that the turbine 16 is not limited to three stages, but may have any number of stages known in the turbine art.

Each of the buckets 22, 24, 26 and nozzles 21, 23, 24 may include an airfoil 34, as shown in FIG. 3. It should be understood, however, that the airfoil 34 of the present disclosure is not limited to an airfoil in a bucket or nozzle, but may be any airfoil known in the art that requires cooling during operation.

The airfoil 34 may include an upper airfoil section 40 and a lower airfoil section 50. Generally, the lower airfoil section 50 includes the base of the airfoil 34, and the upper airfoil section 50 includes the tip of the airfoil 34. For example, the lower airfoil section 50 is generally the section that is mounted at its base to a base or platform which retains the airfoil 34, such as a base or platform that retains the airfoil 34 in a gas turbine system 10. The upper airfoil section 40 may generally be free and unattached, or the upper airfoil section 40 may generally be attached at its tip to another base or platform which retains the airfoil 34. The upper airfoil section 40 may have an outer surface 41. The outer surface 41 may include a pressure side section 42 and a suction side section 44. The pressure side section 42 and suction side section 44 may be connected at a leading edge 46 and a trailing edge 48. Similarly, the lower airfoil section 50 may have an outer surface 51. The outer surface 51 may include a pressure side section 52 and a suction side section 54. The pressure side section 52 and suction side section 54 may be connected at a leading edge 56 and a trailing edge 58.

In an exemplary aspect of an embodiment, the perimeter of the outer surface 51 at any cross-section may generally be larger than the perimeter of the outer surface 41 at any cross-section. Further, in another exemplary aspect of an embodiment, as shown in FIGS. 3, 4, and 5, the perimeter of the outer surface 51 at any cross-section may generally decrease along the length of the airfoil 34 in the radially outward direction, and the perimeter of the outer surface 41 at any cross-section may generally decrease along the length of the airfoil 34 in the radially outward direction. Thus, the airfoil 34 may be tapered along its length from the base of the lower airfoil section 50 through the tip of the upper airfoil section 40. However, in other embodiments, the perimeter of the outer surface 51 at any cross-section may generally be equal to the perimeter of the outer surface 41 at any cross-section. For example, in another exemplary aspect of an embodiment, the perimeter of the outer surface 51 at any cross-section may generally be approximately equal along the length of the airfoil 34, and the perimeter of the outer surface 41 at any cross-section may generally be approximately equal along the length of the airfoil 34. In other embodiments, the perimeter of the airfoil 34 at any cross-section along the length of the airfoil 34 may change according to any airfoil shape or cross-section known in the art.

In an exemplary aspect of an embodiment, the outer surfaces 41 and 51 may be generally aerodynamic outer surfaces, with pressure sides, suction sides, leading edges, and trailing edges as discussed above. The outer surfaces 41 and 51 may further extend through the length of the airfoil 34 in a generally helical, twisting manner, as shown in FIG. 3. However, in other embodiments, the outer surfaces 41 and 51 may extend through the length of the airfoil 34 in a generally straight, non-helical manner.

In an exemplary aspect of an embodiment, the lower airfoil section 50 may at least partially define at least one cooling passage 80 therein. The at least one cooling passage 80 may be configured to flow a cooling medium 90 therethrough. For example, the cooling medium 90 may pass through the at least one cooling passage 80, cooling at least a portion of the airfoil 34. The cooling passage 80 may have any configuration known in the cooling passage art. For example, the cooling passage 80 may extend in a generally straight direction through the airfoil 34, or may extend in a generally curved direction through the airfoil 34, or may extend in a generally serpentine direction through the airfoil 34. Further, the cooling passage 80 may have generally straight components, generally curved components, and generally serpentine components, or any combination thereof.

In an exemplary aspect of an embodiment, the cooling medium 90 may be supplied to the airfoil 34 from the compressor 12. It should be understood, however, that the cooling medium 90 is not limited to a cooling medium supplied by a compressor 12, but may be supplied by any system 10 component or external component known in the airfoil cooling art. Further, the cooling medium 90 is generally cooling air. It should be understood, however, that the cooling medium 90 is not limited to air, and may be any cooling medium known in the airfoil cooling art.

In an exemplary aspect of an embodiment, the at least one cooling passage 80 may be a plurality of cooling passages 80. Further, the plurality of cooling passages 80 may include a plurality of first cooling passages 80 and a plurality of second cooling passages 82. For example, the first cooling passages 80 may be radial cooling passages, and the cooling passages may extend through and be defined within the lower airfoil section 50. The second cooling passages 82, however, may be any cooling passages known in the airfoil cooling art, such as radial cooling passages, serpentine cooling passages, or cooling circuits. Further, the second cooling passages 82 may extend through and be defined within the lower airfoil section 50, the upper airfoil section 40, or both the lower and upper airfoil sections 50 and 40.

The airfoil 34 may further include a transition section 60 disposed between the upper airfoil section 40 and the lower airfoil section 50. The transition section may have an outer surface 61. The outer surface 61 may include a pressure side section 62 and a suction side section 64. The pressure side section 62 and suction side section 64 may be connected at a leading edge 66 and a trailing edge 68.

The transition section 60, such as the outer surface 61, may define at least one cooling hole 85. The at least one cooling hole 85 may be fluidly connected to the at least one cooling passage 80. For example, the cooling medium 90 may flow through the at least one cooling passage 80, and at least a portion of the cooling medium 90 may be exhausted from the airfoil 34 through the at least one cooling hole 85.

In one exemplary aspect of an embodiment, the at least one cooling hole 85 may be disposed adjacent the pressure side sections 42 and 52 of the upper airfoil section 40 and lower airfoil section 50. For example, the at least one cooling hole 85 may be defined by the outer surface 61 in the pressure side section 62 of the transition section 60. In another exemplary aspect of an embodiment, the at least one cooling hole 85 may be disposed adjacent the suction side sections 44 and 54 of the upper airfoil section 40 and lower airfoil section 50. For example, the at least one cooling hole 85 may be defined by the outer surface 61 in the suction side section 64 of the transition section 60. In other exemplary aspects of embodiments, the at least one cooling hole 85 may be disposed adjacent the leading edges 46 and 56 or trailing edges 48 and 58 of the upper airfoil section 40 and lower airfoil section 50. For example, the at least one cooling hole 85 may be defined by the outer surface 61 on the leading edge 66 or trailing edge 68 of the transition section 60.

In one exemplary aspect of an embodiment, the at least one cooling hole 85 may be a plurality of cooling holes 85. The plurality of cooling holes 85 may be disposed adjacent any of the sections of the upper airfoil section 40 and lower airfoil section 50, as discussed above. Further, the plurality of cooling holes 85 may be disposed on the transition section 60 about the periphery of the airfoil, such as about the periphery of the outer surface 61 of the transition section 60. The cooling holes 85 may be defined by the outer surface 61 and disposed about the periphery of the outer surface 61 or about any of the sections 62, 64, 66, or 68 in any pattern known in the airfoil cooling art.

In one exemplary aspect of an embodiment, the at least one cooling hole 85 may be a plurality of cooling holes 85, and the at least one cooling passage 80 may be a plurality of first cooling passages 80 and a plurality of second cooling passages 82, as discussed above. If desired, the cooling holes 85 may be fluidly connected to only the plurality of first cooling passages 80. The second cooling passages 82 may be configured to exhaust the cooling medium 90 through other apertures defined elsewhere on the airfoil, such as through cooling holes defined on the tip of the airfoil 34, cooling holes defined on the platform 32, shank 36, or dovetail 38, film cooling holes defined on the airfoil 34, or any other cooling holes known in the art. Alternatively, however, the cooling holes 85 may be fluidly connected to both the plurality of first cooling passages 80 and the plurality of second cooling passages 82.

In an exemplary aspect of an embodiment, at least a portion of the outer surface 61 of the transition piece 60 may be generally non-coplaner with the outer surface 41 and 51 of the upper airfoil section 40 and lower airfoil section 50. For example, the outer surface 61 of the transition piece 60, or any section 62, 64, 66, or 68 thereof, may be generally non-coplaner with the outer surfaces 41 and 51 of the upper airfoil section 40 and lower airfoil section 50, as shown in FIG. 3. For example, the transition piece 60, or any section 62, 64, 66, or 68 thereof, may be oriented so that the cooling medium 90 is exhausted through the at least one cooling hole 85 in a generally radial direction, as shown in FIG. 4. Alternately, the transition piece 60, or any section 62, 64, 66, or 68 thereof, may be oriented so that the cooling medium 90 is exhausted through the at least one cooling hole 85 in a partially radial direction, as shown in FIG. 5. Further, any individual section or sections 62, 64, 66, or 68 of the transition piece 60 may be generally non-coplaner with the outer surfaces 41 and 51 of the upper airfoil section 40 and lower airfoil section 50, while the remaining sections 62, 64, 66, or 68 may be generally coplanar with the outer surfaces 41 and 51 of the upper airfoil section 40 and lower airfoil section 50. It should be understood that the transition piece 60, and any section 62, 64, 66, and 68 thereof, is not limited to an orientation such that the cooling medium 90 is exhausted through the at least one cooling hole 85 in a radial direction. Rather, the transition piece 60 and sections 62, 64, 66, and 68 may be at any orientation known in the art for allowing a cooling medium 90 to be exhausted through at least one cooling hole 85.

Further, the transition section 60 may include a lower transition edge 72 and an upper transition edge 71. The lower transition edge 72 may provide the interface between the lower airfoil section 50 and the transition section 60. The upper transition edge 71 may provide the interface between the transition section 60 and the upper airfoil section 40. It should be understood that the lower transition edge 72 and upper transition edge 71 may extend around the entire outer surfaces 41, 51, 61, or may extend only partially around the outer surfaces 41, 51, 61, such as through only any individual section or sections 62, 64, 66, or 68. In one exemplary aspect of an embodiment, the lower transition edge 72 and upper transition edge 71 may be generally sharp edges, as shown in FIG. 4. In another exemplary aspect of an embodiment, the lower transition edge 72 and upper transition edge 71 may be generally smooth, rounded edges, as shown in FIG. 5. For example, the lower transition edge 72 may be a generally smooth, convex edge, and the upper transition edge 71 may be a generally smooth, concave edge. In other embodiments, one of the lower transition edge 72 and upper transition edge 71 may be a generally sharp edge, and the other may be generally smooth, rounded edge. Further, in other embodiments, the lower transition edge 72 and upper transition edge 71 may have any edge configuration known in the art.

The transition section 60 of the present disclosure may be disposed anywhere along the length of the airfoil 34. For example, in one embodiment, the transition section 60 may be disposed approximately in the middle of the airfoil 34. In this embodiment, the length of upper airfoil section 40 may be approximately equal to the length of lower airfoil section 50. In another embodiment, however, the transition section 60 may be disposed such that the length of upper airfoil section 40 is approximately half of the length of lower airfoil section 50. In other embodiments, the transition section 60 may be disposed such that the length of upper airfoil section 40 is, for example, approximately one-third, one-fourth, one-fifth, one-tenth, one-twentieth, or any other fraction known in the art, of the length of lower airfoil section 50. In still further embodiments, the transition section 60 may be disposed such that the length of the lower airfoil section 50 is, for example, approximately one-half, one-third, one-fourth, one-fifth, one-tenth, one-twentieth, or any other fraction known in the art, of the length of upper airfoil section 40.

In an exemplary aspect of an embodiment, the airfoil 34 may be included in a bucket assembly 30, as shown in FIG. 3. The bucket assembly 30 may be incorporated into any turbine stage known in the art. For example, in some embodiments, the bucket assembly 30 may be a first stage bucket 22 or a second stage bucket 24. Alternatively, the bucket assembly 30 may be a latter-stage bucket, such as, for example, a third stage bucket 26, fourth stage bucket, fifth stage bucket, or any other bucket known in the art.

The bucket assembly 30 may include a platform 32, the airfoil 34, and a shank 36. The airfoil 34 may extend radially outward from the platform 32. The shank 36 may extend radially inward from the platform 32. The shank 36 may at least partially define the cooling passages 80 or cooling passages 80 and 82 therein.

The bucket assembly 30 may further include a dovetail 38. The dovetail 38 may extend radially inward from the shank 36. In an exemplary aspect of an embodiment, the dovetail 38 may be configured to couple the bucket assembly 30 to the shaft 18. For example, the dovetail 38 may secure the bucket assembly 30 to a rotor disk (not shown) disposed on the shaft 18. A plurality of bucket assemblies 30 may thus be disposed circumferentially about the shaft 18 and coupled to the shaft 18, forming a rotor assembly 20. If desired, the dovetail 38 may be configured to supply the cooling medium 90 to the cooling passages 80 or cooling passages 80 and 82 defined within the airfoil 34. For example, first cooling passage inlets 92 of the cooling passages 80 and second cooling passage inlets 94 of the cooling passages 82 may be defined by the dovetail 38. It should be understood, however, that first cooling passage inlets 92 and second cooling passage inlets 94 are not limited to positions defined by the dovetail 38, and may be, for example, defined on the shank 36, the platform 32, or the base of the airfoil 34. Further, in one embodiment, the dovetail 38 may be configured to allow the cooling medium 90 to exit the cooling passages 82 after passing through the airfoil 34 within the cooling passages 82. For example, second cooling passage outlets 96 of the cooling passages 82 may be defined by the dovetail 38. It should be understood, however, that cooling passage outlets 96 are not limited to positions defined by the dovetail 38, and may be, for example, cooling holes defined on the tip of the airfoil 34, cooling holes defined on the platform 32 or the shank 36, film cooling holes defined on the airfoil 34, or any other cooling holes known in the art. The cooling medium 90 may enter the cooling passages 80 and 82 through the inlets 92 and 94 and exit the cooling passages 80 and 82 through the cooling holes 85 and outlets 96, respectively.

The present disclosure is also directed to a method for cooling an airfoil 34. The method may include, for example, the step of providing a cooling medium 90 to the airfoil 34. The cooling medium 90 may be provided, for example, through at least one cooling passage 80, or through a plurality of cooling passages 80 and 82, as discussed above. The method may further include, for example, the step of flowing the cooling medium 90 through at least a portion of the airfoil 34. For example, the cooling medium 90 may flow through the at least one cooling passage 80 or plurality of cooling passages 80 and 82 within at least a portion of the airfoil 34, as discussed above.

The method may further include, for example, the step of exhausting the cooling medium 90 from the airfoil 34. For example, the cooling medium 90 may be exhausted from the cooling passages 80 through at least one cooling hole 85 or a plurality of cooling holes 85, as discussed above.

As discussed above, the airfoil 34 may include an upper airfoil section 40 and a lower airfoil section 50. The upper airfoil section 40 may have an outer surface 41. The outer surface 41 may include a pressure side section 42 and a suction side section 44. The pressure side section 42 and suction side section 44 may be connected at a leading edge 46 and a trailing edge 48. Similarly, the lower airfoil section 50 may have an outer surface 51. The outer surface 51 may include a pressure side section 52 and a suction side section 54. The pressure side section 52 and suction side section 54 may be connected at a leading edge 56 and a trailing edge 58. The lower airfoil section 50 may at least partially define at least one cooling passage 80 therein. The at least one cooling passage 80 may be configured to flow a cooling medium 90 therethrough, cooling at least a portion of the airfoil 34.

As discussed above, the airfoil 34 may further include a transition section 60 disposed between the upper airfoil section 40 and the lower airfoil section 50. The transition section 60 may have an outer surface 61. The outer surface 61 may include a pressure side section 62 and a suction side section 64. The pressure side section 62 and suction side section 64 may be connected at a leading edge 66 and a trailing edge 68. The transition section 60, such as the outer surface 61, may define at least one cooling hole 85. The at least one cooling hole 85 may be fluidly connected to the at least one cooling passage 80, such that at least a portion of the cooling medium 90 may be exhausted through the at least one cooling hole 80.

The method and apparatus of the present disclosure allow for the cooling of an airfoil utilizing radial cooling passages without requiring the cooling passages to extend through the entire length of the airfoil. Additionally, the method and apparatus of the present disclosure provides a cooling device that allows radial cooling of the airfoil and that allows the cooling medium to be exhausted from the airfoil along the length of the airfoil. Further, the method and apparatus of the present disclosure allow cooling of the lower section of an airfoil, which in many cases is the limiting section of the airfoil with regard to exposure to and survival in a hot gas path.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An airfoil comprising:

an upper airfoil section and a lower airfoil section, each of the upper and lower airfoil sections having an outer surface including a pressure side section, a suction side section, a leading edge, and a trailing edge;

at least one cooling passage defined at least partially within the lower airfoil section, the at least one cooling passage configured to flow a cooling medium therethrough, cooling at least a portion of the airfoil; and a transition section disposed between the upper airfoil section and the lower airfoil section and having an outer surface, the outer surface defining at least one cooling hole, the at least one cooling hole fluidly connected to the at least one cooling passage, wherein at least a portion of the cooling medium is exhausted through the at least one cooling hole.

2. The airfoil of claim 1, wherein at least a portion of the outer surface of the transition section is generally non-coplaner with the outer surfaces of the upper airfoil section and the lower airfoil section.

3. The airfoil of claim 1, wherein the at least one cooling hole is disposed adjacent the pressure side sections of the upper airfoil section and the lower airfoil section.

4. The airfoil of claim 1, wherein the at least one cooling hole is disposed adjacent the suction side sections of the upper airfoil section and the lower airfoil section.

5. The airfoil of claim 1, wherein the at least one cooling hole is disposed adjacent the leading edges of the upper airfoil section and the lower airfoil section.

6. The airfoil of claim 1, wherein the at least one cooling hole is disposed adjacent the trailing edges of the upper airfoil section and the lower airfoil section.

7. The airfoil of claim 1, wherein the at least one cooling passage is a plurality of cooling passages and the at least one cooling hole is a plurality of cooling holes.

8. The airfoil of claim 7, wherein the plurality of cooling holes are disposed about the periphery of the airfoil.

9. The airfoil of claim 7, wherein the plurality of cooling passages includes a plurality of first cooling passages and a plurality of second cooling passages, and wherein the plurality of cooling holes are fluidly connected to only the plurality of first cooling passages.

10. The airfoil of claim 9, wherein the plurality of second cooling passages are further defined within the upper airfoil section.

11. The airfoil of claim 1, wherein the length of the upper airfoil section is approximately equal to the length of the lower airfoil section.

12. The airfoil of claim 1, wherein the length of the upper airfoil section is approximately half of the length of the lower airfoil section.

13. A bucket assembly comprising:

a platform;

a shank extending radially inward from the platform; and an airfoil extending radially outward from the platform, the airfoil including an upper airfoil section, a lower airfoil section, and a transition section, each of the upper and lower airfoil sections having an outer surface including a pressure side section, a suction side section, a leading edge, and a trailing edge, the lower airfoil section at least partially defining at least one cooling passage, the at least one cooling passage configured to flow a cooling medium therethrough, cooling at least a portion of the airfoil, the transition section disposed between the upper airfoil section and the lower airfoil section and having an outer surface, the outer surface defining at least one cooling hole, the at least one cooling hole fluidly connected to the at least one cooling passage, wherein at least a portion of the cooling medium is exhausted through the at least one cooling hole.

14. The bucket assembly of claim 13, wherein at least a portion of the outer surface of the transition section is generally non-coplaner with the outer surfaces of the upper airfoil section and the lower airfoil section.

15. The bucket assembly of claim 13, wherein the at least one cooling hole is disposed adjacent the pressure side sections of the upper airfoil section and the lower airfoil section.

16. The bucket assembly of claim 13, wherein the at least one cooling hole is disposed adjacent the suction side sections of the upper airfoil section and the lower airfoil section.

17. The bucket assembly of claim 13, wherein the at least one cooling passage is a plurality of cooling passages and the at least one cooling hole is a plurality of cooling holes.

18. The bucket assembly of claim 17, wherein the plurality of cooling holes are disposed about the periphery of the airfoil.

19. The bucket assembly of claim 17, wherein the plurality of cooling passages includes a plurality of first cooling passages and a plurality of second cooling passages, and wherein the plurality of cooling holes are fluidly connected to only the plurality of first cooling passages.

20. The bucket assembly of claim 19, wherein the plurality of second cooling passages are further defined within the upper airfoil section.

* * * * *